United States Patent [19]

Bolliger

[11] Patent Number: 4,602,668

[45] Date of Patent: Jul. 29, 1986

[54] REGULATING DISTANCE BETWEEN NOZZLE AND CATERPILLAR TYPE MOLD IN PROCESS OF AND APPARATUS FOR CONTINUOUS CASTING

[75] Inventor: Martin Bolliger, Venthône, Switzerland

[73] Assignee: Swiss Aluminium Ltd., Chippis, Switzerland

[21] Appl. No.: 613,631

[22] Filed: May 24, 1984

[30] Foreign Application Priority Data

Jun. 1, 1983 [CH] Switzerland ..... 3010/83

[51] Int. Cl.[4] ..... B22D 11/06; B22D 11/16

[52] U.S. Cl. ..... 164/452; 164/154; 164/430; 164/440; 164/481; 164/490

[58] Field of Search ..... 164/452, 453, 481, 488, 164/490, 430, 437, 438, 440, 154, 155

[56] References Cited

U.S. PATENT DOCUMENTS 4,217,947 8/1980 Gyongyos et al. ..... 164/479

4,290,477 9/1981 Huber et al. ..... 164/437 X

*Primary Examiner*—Nicholas P. Godici

*Assistant Examiner*—J. Reed Batten, Jr.

*Attorney, Agent, or Firm*—Bachman & LaPointe

[57] ABSTRACT

A process and nozzle for the continuous casting of molten metal to the mold of a caterpillar track type mold wherein the distance of the nozzle from the moving mold belts is regulated during the casting operation by altering the temperature at a plurality of places inside the nozzle body and/or by creating a pressurized gas cushion at a plurality of locations between the nozzle and the moving mold belts. The nozzle for feeding molten metal to the mold includes heating elements for altering the temperature of the nozzle and, if desired, at least one gas channel for forming a gas cushion between the nozzle and the moving mold belts.

8 Claims, 1 Drawing Figure

REGULATING DISTANCE BETWEEN NOZZLE AND CATERPILLAR TYPE MOLD IN PROCESS OF AND APPARATUS FOR CONTINUOUS CASTING

BACKGROUND OF THE INVENTION

The present invention relates to a process and nozzle for feeding molten metal to the mold of a caterpillar track type mold and, more particularly, a process and nozzle for feeding molten metal wherein the distance of the nozzle from the moving mold belts is regulated during the casting operation.

One of the most difficult problems encountered in continuous casting, in particular in casting ferrous and non-ferrous metals, is the design of feeder nozzles by means of which the molten metal is introduced into the mold between the moving mold belts of a caterpillar track type mold. In the case of a caterpillar track type casting machine relatively thin strips are cast, that is, strips of 20 mm thickness and less. Accordingly the nozzles must be of relatively small dimensions especially in the region of the nozzle's mouthpiece.

There are considerable damage risks involved with the nozzles because of the very high temperature of the metal flowing through the nozzle. Only a few materials can withstand erosion or dissolution in the metal. One of the few materials which meet these requirements is graphite. Graphite, however, suffers from the disadvantage of high thermal conductivity which results in the heat is conducted away so quickly from the melt that the metal has a tendency to solidify in the nozzle.

Another suitable refractory material used widely in casting aluminum is a mixture of 30% diatomaceous earth (almost pure silica in the form of microscopic cells), 30% long asbestos fibers, 20% sodium silicate (dry mixture) and 20% chalk (to form calcium silicate). For casting steel nozzles made of $ZrO_2$ or $ZrSiO_4$ are generally employed.

The nozzles must withstand not only thermal stresses which arise due to the temperature of the metal being cast but also must withstand the resultant chemical attack and the mechanical stresses due to fluctuating movements of the mold belts and bending of the nozzle due to the relatively large weight of the melt passing through it. The bending leads to friction between the nozzle and the mold belts and thus to destruction of the nozzle.

Disclosed in the Swiss patent CH-PS 508 433 is a feeding nozzle which features, on the outside close to the outer edge of the nozzle, inserts which run around the whole periphery thereof. The inserts are made of a self-lubricating material. These inserts project sufficiently beyond the surface of the nozzle that they prevent any direct contact between the nozzle surface and the mold belts and prevent the molten metal from penetrating the small clearance gap between the nozzle and the mold belts. It has been found that traces of the graphite inserts rub off and behave as "activated" strips which produce faster solidification and a corresponding non-uniform structure, often resulting in surface cracks on the cast strip.

Accordingly, it is the principal object of the present invention to develop a process for use with a caterpillar track type mold which counters the mechanical bending of the nozzle and thus rubbing of the nozzle on the mold belts.

It is a further object of the present invention to develop a nozzle which is suitable for carrying out the foregoing process.

SUMMARY OF THE INVENTION

The foregoing object is achieved by way of the present invention wherein the distance of the nozzle from the moving mold belts is regulated during the operation of the casting machine.

The distance of the nozzle from the moving mold belts is controlled by means of two separate and/or combined process steps. In one case the distance of the nozzle from the moving mold belts forming the mold gap is regulated by changing the temperature inside the nozzle at a plurality of sites in the nozzle. This case employs the ability of materials to expand with increasing temperature. If the nozzle is heated differently at a plurality of sites then it is possible to counter bending of the nozzle. This can be achieved, in particular, if a different amount of heat is applied at the top than at the bottom of the nozzle.

In the second case the distance of the nozzle from the moving mold belts can be regulated by creating a pressure gas cushion at a plurality of places between the nozzle and the moving mold belts. By establishing the pressure cushion the two parts of the device are kept a distance apart with a relatively high pressure prevailing therebetween.

It is also within the scope of the present invention that the differences in distance between the nozzle and the mold belts be measured and registered by means of a measuring sensor operating on the principle of the hydrodynamic paradox such as described in the Swiss patent application No. 7410/82-7. On the basis of the measurements obtained the actual value is compared with the desired value in a control unit and the temperature at specific places in the nozzle body changed accordingly.

The present invention embraces also a nozzle for feeding molten metal into the mold gap between the moving mold belts of a caterpillar track type mold wherein the nozzle features in the body thereof heating elements via and by means of which the distance of the nozzle from the moving mold belts of the casting machine can be regulated.

In the simplest case conductor wires can be mounted in the nozzle body and connect up with heating elements at specific distances. In this way the nozzle body can be heated to different temperatures at various locations. The heating elements and conductor wires can be connected up to a measurement and control unit.

In another case air channels which pass through the nozzle body and communicate with the region between the nozzle and the mold belts can pass gas therethrough to establish a gas pressure cushion between the nozzle and the moving mold belts.

In order to regulate the temperature and/or the gas pressure cushion, pins which can be lowered into the nozzles, similar to these illustrated in the Swiss patent application No. 7410/82-7 and likewise functioning on the basis of the hydrodynamic, can be inserted so that the distance of the nozzle body from the mold belts can be measured. The movement of the pins are registered by a displacement transducer mounted in the nozzle body and fed to the measurement and control unit.

The facilities for determining the distance are preferably situated in or on metal supports which, together with hollow sections that are joined by them and feature outlets for the molten metal, form the nozzle body. These metal supports have the advantage for example that if they house the air channels they do not cool the nozzle which in the worst case could lead to the metal freezing in the nozzle as they do not come into direct contact with the melt. On the other hand, the metal supports are particularly suitable for taking up temperature differences quickly and enabling thermal expansion to take place.

DETAILED DESCRIPTION

Figure 1:
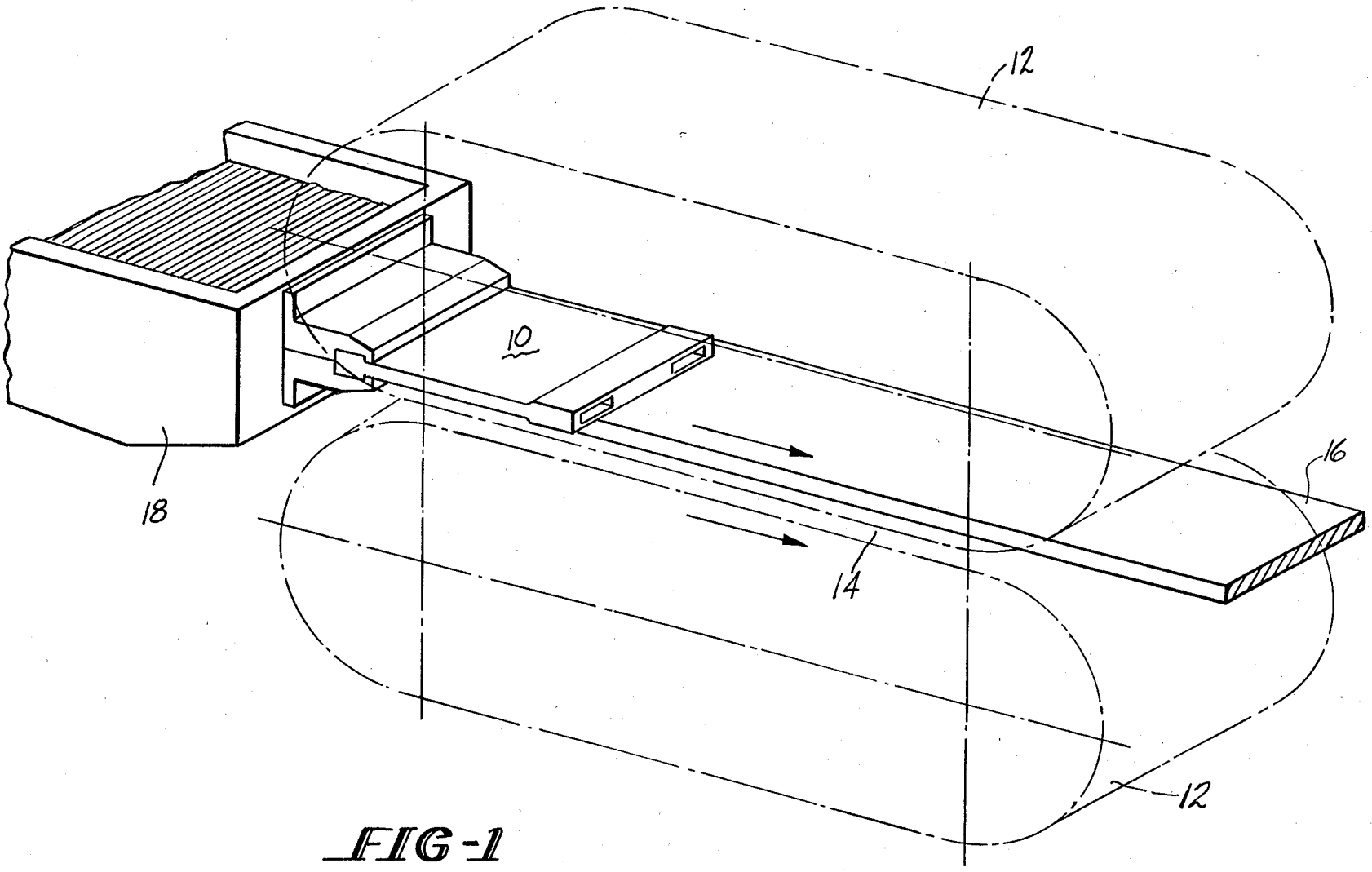
FIG. 1 is a perspective view of the nozzle of the present invention projecting into the mold cavity of a strip casting machine having moving mold belts.

With reference to FIG. 1, a pair of mold belts 12 of a continuous cast machine (not shown) define a mold cavity 14 for casting metal strip 16. The nozzle of the present invention 10 projects into mold cavity 14 for delivering molten metal to same from tundish 18.

Figure 2:
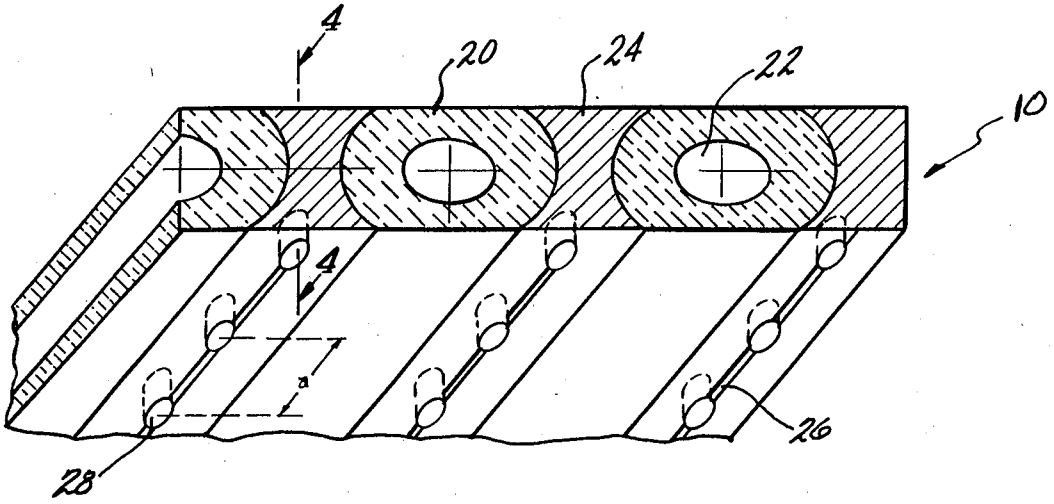
FIG. 2 is a longitudinal and transverse cross section through the nozzle of the present invention.

Referring now to FIG. 2, nozzle 10 comprises a plurality of hollow sections 20 each provided with an outlet channel 22 for delivering molten metal to mold cavity 14. Hollow sections 20, made of a refractory material and in particular a ceramic material, are connected together by metal supports 24. As can be seen in FIG. 2, built into the metal supports 24 are electrical conductors 26 from which heating elements 28 branch off at specific distances along the nozzle 10.

Measuring sensors, not shown here, for determining the position of the nozzle 10 are provided on the nozzle 10. The sensors communicate the measured values to a control unit 30 in which the actual and intended values are compared. This control unit 30 feeds a control signal in response to the compared values to regulate the flow of electric current to the heating elements 28.

Figure 4:
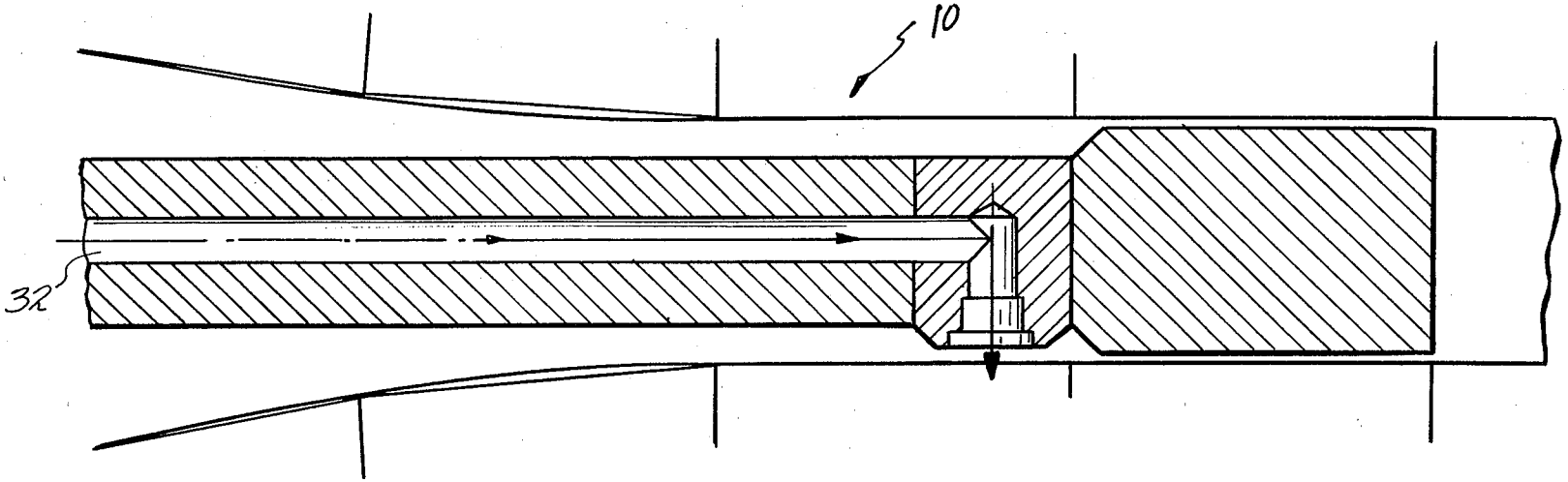
FIG. 4 is a sectional view taken along line 4—4 of FIG. 2 illustrating the air channels in a second embodiment of the nozzle of the present invention.

Additionally, as can be seen from FIG. 4, the metal supports 24 may be penetrated by air channels 32 which emerge from the nozzle 10 on the upper and/or lower sides thereof in the region where the nozzle projects into the mold cavity 14. By means of these air channels a so called hydrodynamic paradox, that is, a gas cushion which prevents the outer surface of the nozzle from coming into contact with the mold belts 12 is established between the nozzle 10 and the mold belts 12. The regulation of the flow of air through the various air channels 32 is controlled by control unit 30 as will be described.

Figure 3:
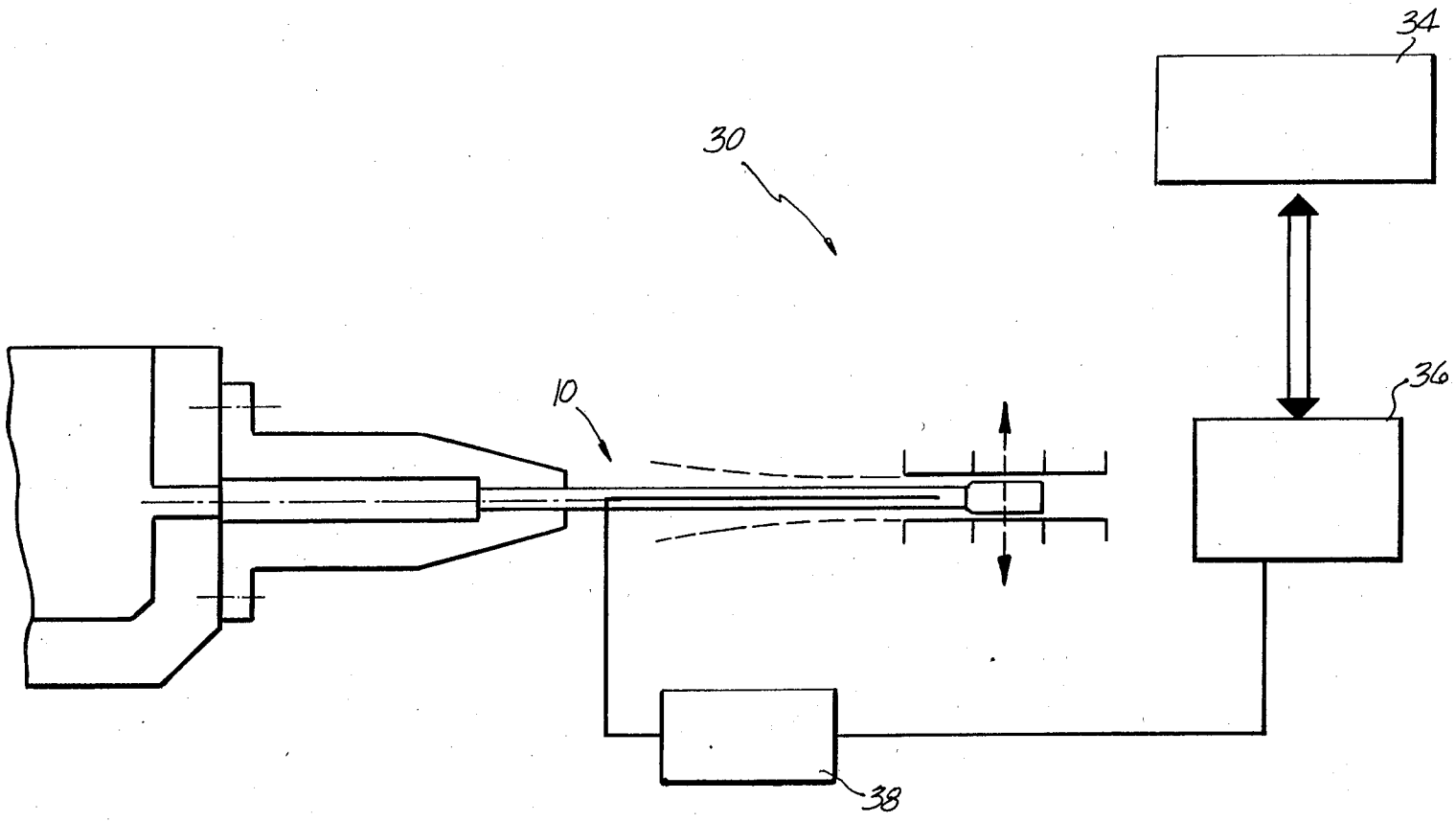
FIG. 3 is a schematic illustration of the control unit for controlling the flow of electrical current and air to the nozzle of the present invention.

With reference to FIG. 3, control unit 30 comprises a pair of computers 34 and 36 for controlling the flow of current to heating elements 28 and the supply of gas to channels 32 from gas supply 38.

The hydrodynamic paradox should, in a further exemplified embodiment of the present invention, also find application as a measuring sensor for controlling the heating elements 28. To this end, the upper and/or lower side of the nozzle 10 is fitted with pins which can be lowered and out of which air flows on to the walls of the moving mold belts 12. In the nozzle body 10, in particular on the metal supports 24, is a displacement transducer which communicates the movement of the pins to control unit 30. This in turn regulates the heating of the metal supports 24.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for feeding molten metal to a caterpillar track type mold having opposed moving mold belts comprising providing a nozzle for feeding molten metal to the mold and regulating the distance of the nozzle from the moving mold belts during operation of the caterpillar track type mold by altering the temperature inside the nozzle at a plurality of places on the nozzles.

2. A process according to claim 1 wherein the distance of the nozzle from the mold belts is monitored by a sensor functioning on the principle of the hydrodynamic paradox and the temperature is accordingly altered at a plurality of places on the nozzle body.

3. An apparatus for the continuous casting of molten metal comprising in combination a caterpillar track type mold having opposed moving belts and a nozzle for feeding said molten metal to said mold, the improvement comprising heating elements provided on said nozzle at various locations thereon defining means for regulating the distance between the nozzle and the moving mold belts by thermal expansion.

4. An apparatus according to claim 3 wherein the nozzle comprises a plurality of metal supports and a plurality of hollow sections mounted alternately in side-by-side relationship wherein said heating elements are provided in said plurality of metal supports.

5. An apparatus according to claim 3 wherein electrical conductors are incorporated in the nozzle and are connected to the heating elements.

6. An apparatus according to claim 5 wherein the heating elements are connected via the electrical conductors to a measurement and control unit.

7. An apparatus according to claim 6 wherein the nozzle is provided with air channels which communicate with the region between the nozzle and the mold belts for feeding gas to said region so as to create a gas pressure cushion.

8. An apparatus according to claim 7 wherein pins are provided to measure the distance between the nozzle and the mold belts on the nozzle body between which pins and the mold belts a gas cushion can be created such that the movement of the pins can be transmitted to the measurement and control unit via displacement transducers.

* * * * *